United States Patent [19]

Nagasaki et al.

[11] Patent Number: 4,798,383

[45] Date of Patent: Jan. 17, 1989

[54] GOLF CLUB HEAD

[75] Inventors: Yoichi Nagasaki; Itsushi Nagamoto; Toyohiko Tadokoro; Masaki Fujimura, all of Hamamatsu, Japan

[73] Assignee: Yamaha Corporation, Japan

[21] Appl. No.: 821,029

[22] Filed: Jan. 21, 1986

[30] Foreign Application Priority Data

Jan. 29, 1985 [JP] Japan ..... 60-15145
Sep. 9, 1985 [JP] Japan ..... 60-199034
Sep. 27, 1985 [JP] Japan ..... 60-214297

[51] Int. Cl.[4] ..... A63B 53/04

[52] U.S. Cl. ..... 273/167 H; 273/171; 273/173

[58] Field of Search ..... 273/78, 173, 167 H, 273/169, 167 F, 171, 170, 172, 174, 167 J, 167 K

[56] References Cited

U.S. PATENT DOCUMENTS 632,885 9/1899 Sweny ..... 273/78
699,624 5/1902 Kempshall ..... 273/78
2,034,936 3/1936 Barnhart ..... 273/173 X
2,447,967 8/1948 Stone ..... 273/169
2,846,228 8/1958 Reach ..... 273/169
3,847,399 11/1974 Raymont ..... 273/169
3,975,023 8/1976 Inamori ..... 273/173
4,653,756 3/1987 Sato ..... 273/169

FOREIGN PATENT DOCUMENTS 9862 of 1906 United Kingdom ..... 273/78
1201648 8/1970 United Kingdom ..... 273/169

*Primary Examiner*—George J. Marlo
*Attorney, Agent, or Firm*—Lerner, David, Littenberg, Krumholz & Mentlik

[57] ABSTRACT

An improved golf club head includes a metallic main body 1 having a face side section 2 providing a face side surface for shooting balls. A rearwardly opening gouge 3 is formed within the main body, extending to an end wall 3*a* provided by the face side section. An FRP plate 4 is inserted into the gouge and attached to the end wall. Presence of the light FRP plate in the face side region allows free weight assignment to other regions for ideal inertia moment adjustment and produces locally laminated face side construction in which thickness ratio of components can be adjusted for better feel at shooting.

2 Claims, 5 Drawing Sheets

GOLF CLUB HEAD

BACKGROUND OF THE INVENTION

The present invention relates to an improved golf club head, and more particularly, the invention relates to the improvement in shooting of golf balls by a golf club head containing a fiber reinforced plastic (FRP) element.

Although the following descriptions are directed to iron golf club heads, the present invention is also applicable to wooden golf club heads, as evidenced by the later disclosed example.

One typical example of the conventional iron golf club head has a main body made of stainless steel, cast iron or brass. Another conventional iron golf club head has a main body which is made up of a metallic core, a metallic sole section and an FRP shell covering the core and the face side section. In particular, an iron golf club head with a CFRP (carbon fiber reinforced plastics) shell has greatly gained the attention of golf players.

Since the face side surface is provided by a highly elastic CFRP shell, the iron golf club head of this type assures significantly long distance shooting of balls, reduced weight of the head and correct shooting in the intended direction.

When wholly made of metal, such a golf club head cannot assure ideal feel during shooting. In addition, no local weight adjustment can be effected inasmuch as the main body is made of a single material of uniform specific gravity. This disenables free inertia moment adjustment of the golf club head.

When an FRP shell is employed, the face side surface provided by a CFRP shell is rather vulnerable to damage. Combination of a heavy core with a light shell again does not allow easy and free inertia moment adjustment. Further, since the metallic core is arranged behind the CFRP providing the face side surface, the characteristics of the CFRP is subdued by influence of characteristics of the metallic material.

SUMMARY OF THE INVENTION

It is one object of the present invention to assure ideal feel while shooting balls by a golf club head.

It is another object of the present invention to enable free and easy inertia moment adjustment on a golf club head.

It is a further object of the present invention to develop, in a golf club head containing an FRP element, functional advantages of the FRP element as much as possible.

In accordance with the basic concept of the present invention, a main body has a face side surface for shooting balls and an FRP plate arranged in the face side region of the main body substantially in parallel to the face side surface.

DESCRIPTION OF THE PREFERRED EMBODIMENTS

Figure 1:
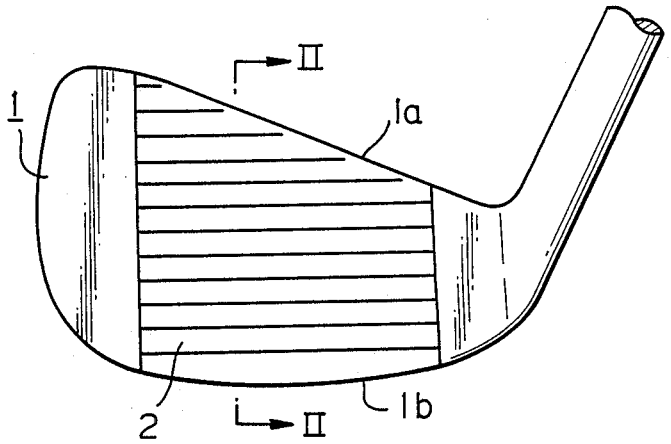
FIG. 1 is a front view of one embodiment of the golf club head in accordance with the present invention.

In the following description, substantially like elements in different embodiments are indicated with like reference numerals.

Figure 2:
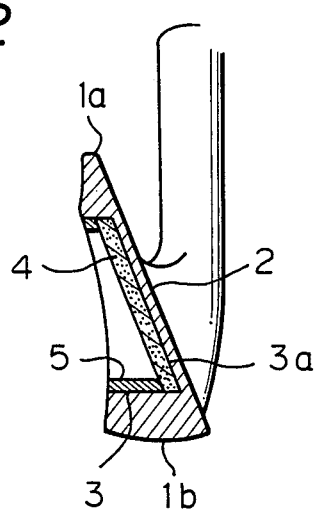
FIG. 2 is a section taken along the line II—II in FIG. 1.
Figure 3:
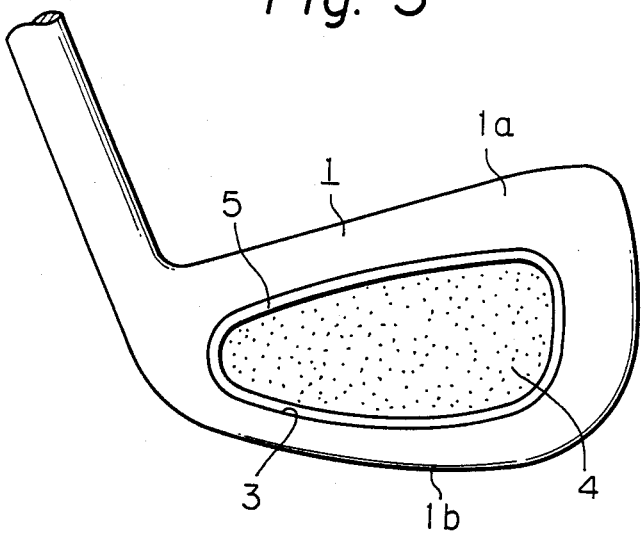
FIG. 3 is a rear view of the golf club head shown in FIG. 1.

The first embodiment of the golf club head in accordance with the present invention is shown in FIGS. 1 to 3. In the case of this embodiment, the main body of the golf club head is made of metal and has a face side section providing a face side surface and an FRP plate attached to the rear side of the face side section of the main body.

More specifically in FIG. 1, the golf club head includes a metallic main body 1 having a face side section 2 providing a face side surface for shooting balls. On the rear side of the face side section 2, there is a local gouge 3 formed between the upper and lower edges 1*a*, 1*b* of the main body 1 while opening rearwards. An FRP plate 4 is inserted into the gouge 3 and tightly attached to the flat end wall 3*a* of the gouge 3 to form a locally laminated face side construction. A configurated frame or ring 5 is also force inserted into and bonded to the gouge 3 in order to press the FRP plate 4 tightly against the rear side of the face side section 2, i.e. the end wall 3*a* of the gouge 3.

The thickness of the face side section 2 of the main body 1 should preferably be in a range from 0.5 to 3.0 mm. On the other hand, the thickness of the FRP plate 4 should preferably be in a range from 1.0 to 5.0 mm.

Weight reduced in the face side region by addition of the light FRP plate may be assigned to another region or regions of the main body 1 such as the sole side and back side section. Such possibility of weight assignment enables free and ideal inertia moment adjustment of the golf club head.

The FRP plate 4 is prepared in reference to the amount of weight to be reduced in the face side region for inertia moment adjustment. In one example, a plurality of sheets of reinforcing fibers are combined in layers and the layered combination is impregnated with a matrix bath of synthetic resins such as epoxy resin and unsaturated epoxy resin for subsequent hardening. In an alternative embodiment, thin hardened FRP plates may be combined in piles.

Reinforcing fibers are used in two or three dimensional woven or knitted masses. The masses may take the form of cloths, combinations of cloths with rovings, mats and mats combined with cloths.

Carbon fibers are typically used for reinforcement. In combination with carbon fibers as the major component, at least one aromatic polyamide fibers, glass fibers, boron fibers, silicon carbide fibers and alumina fibers may be advantageously used for reinforcement. Further, fiber reinforced metal may be used for this purpose in which metal works as a matrix.

By thickness ratio adjustment in the locally laminated face side construction of the main body, feel while shooting of balls can be subtly adjusted. Weight assignment from the face side region allows free and ideal inertia moment adjustment on the golf club head. The metallic face side surface greatly endures any type of damage.

The second embodiment of the golf club head in accordance with the present invention is shown in FIGS. 4 to 9. In the case of this embodiment, the main body has a gouge formed therethrough in the shooting direction, i.e. a direction substantially normal to the face side surface, and an FRP plate closes the face side opening of the gouge in the main body.

Figure 4:
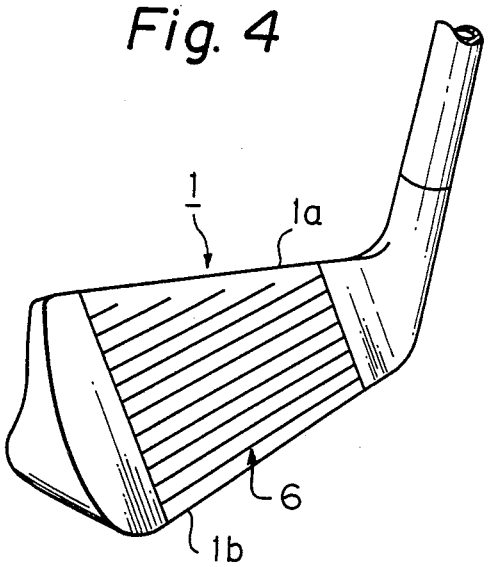
FIG. 4 is a perspective view of another embodiment of the golf club head in accordance with the present invention.
Figure 5:
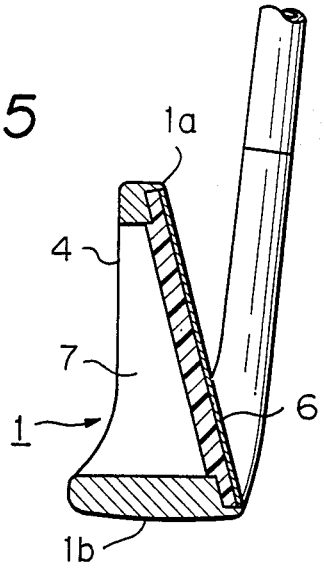
FIG. 5 is a side sectional view, partly in section, of the golf club head shown in FIG. 4.
Figure 6:
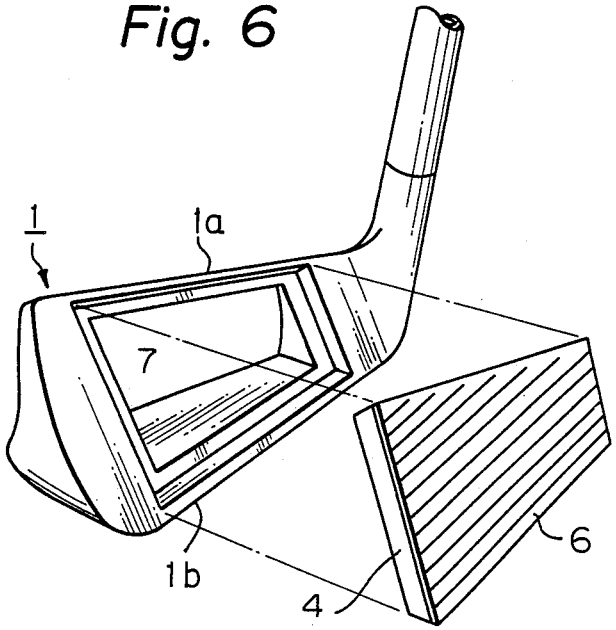
FIG. 6 is a perspective view of the golf club head shown in FIG. 4 in a disassembled state.

More specifically in FIGS. 4 to 6, a gouge 7 is formed through the main body 1 between the upper and lower edges 1*a*, 1*b* and its face side opening being closed by an FRP plate 4. The front surface of the FRP plate 4 is plated with a metal layer 6.

Figure 7:
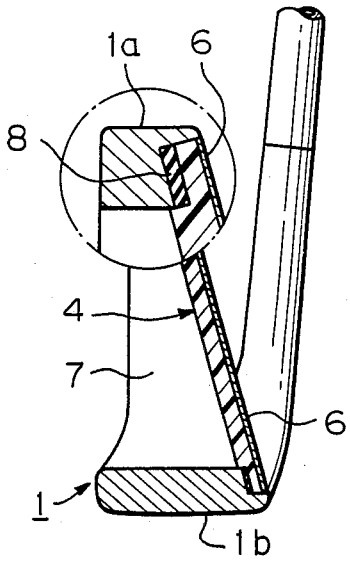
FIG. 7 is a side view, partly in section and enlarged, of a further embodiment of the golf club head in accordance with the present invention.

A modification is shown in FIG. 7, in which an elastic member 8 is interposed between the main body 1 and the FRP plate 4. Presence of such an elastic member 8 promotes transmission of kinetic energy from the highly elastic golf club head to a lowly elastic ball at shooting balls.

Figure 8:
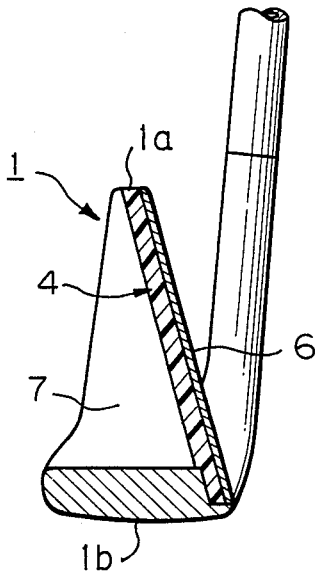
FIG. 8 is a side view, partly in section, of a still further embodiment of the golf club head in accordance with the present invention.

Another modification is shown in FIG. 8, in which the gouge 7 opens upwards.

Figure 9:
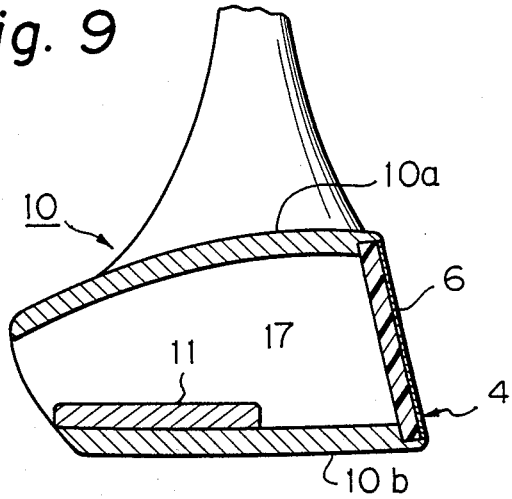
FIG. 9 is a side view, partly in section, of a still further embodiment of the golf club head in accordance with the present invention.

As briefly mentioned already, the present invention is particularly applicable to a wooden golf club head. One example is shown in FIG. 9, in which a main body 10 is provided with a gouge 17 formed therethrough and its face side opening is closed by an FRP plate 4 accompanied with a metal layer 6. A weight 11 may be arranged in the gouge 17 for adjustment in the position of the center of gravity.

Figure 10:
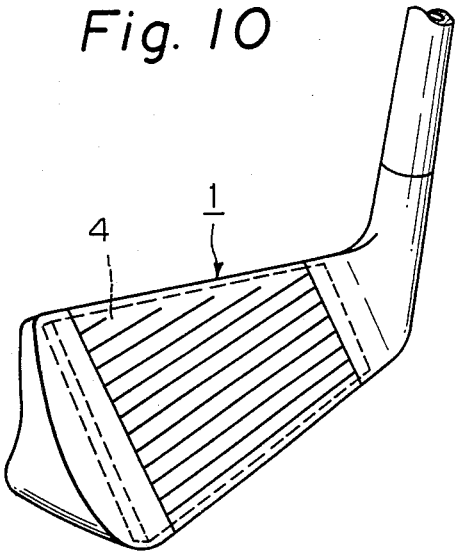
FIG. 10 is a perspective view of a still further embodiment of the golf club head in accordance with the present invention.
Figure 11:
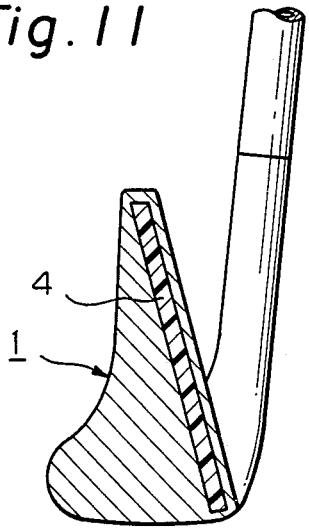
FIG. 11 is a side view, partly in section, of the golf club head shown in FIG. 10.

The third embodiment of the golf club head in accordance with the present invention is shown in FIGS. 10 and 11, in which an FRP plate is fully embedded in the main body 1 near the face side surface.

We claim:

1. An improved golf club head comprising:

a main body constructed of metal and having a face side section of substantially uniform thickness and providing a planar face side surface for striking golf balls, said main body having a rear opening extending therein towards said face side surface between upper and lower edges of said body to an end wall provided by a rear side surface of said face side section, a fiber reinforced plastic plate of substantially uniform thickness in the range of 5.0 mm or less fixed to said end wall parallel to said face side surface, the upper and lower edges of said body forming said opening extending beyond the thickness of said fiber reinforced plastic plate, said fiber reinforced plastic plate being formed as a solid planar body having uniform density throughout, the density of said fiber reinforced plastic plate being such that it provides a lighter mass than would otherwise be present if said fiber reinforced plastic plate were made of the same material as that of said main body.

2. An improved golf club head as claimed in claim 1 in which said face side section has a uniform thickness in a range from 0.5 to 3.0 mm.

* * * * *